United States Patent [19]

Khinchuk

[11] Patent Number: 4,796,816

[45] Date of Patent: Jan. 10, 1989

[54] IMPINGING-JET FUEL INJECTION NOZZLE

[76] Inventor: Gregory Khinchuk, 15 Westbourne Ter., Apt. 3, Brookline, Mass. 02146

[21] Appl. No.: 98,689

[22] Filed: Sep. 21, 1987

[51] Int. Cl.[4] ..... B05B 15/02; B05B 1/26; F02M 61/16

[52] U.S. Cl. ..... 239/501; 239/517; 239/533.12; 239/118; 15/246

[58] Field of Search ..... 239/114–118, 239/500, 501, 505, 519, 517, 512, 533.2–533.12, 518, 524, 533.13; 15/246

[56] References Cited

U.S. PATENT DOCUMENTS

| | | | |
|---|---|---|---|
| 244,740 | 7/1881 | Brown | 239/517 |
| 1,089,406 | 3/1914 | Fitts | 239/116 |
| 1,305,411 | 6/1919 | Rico | 239/517 |
| 2,704,174 | 3/1955 | Uxa | 239/518 X |
| 3,339,848 | 9/1967 | Geiger | 239/453 |
| 3,391,871 | 7/1968 | Fleischer . | |
| 3,425,635 | 2/1969 | Guertler | 239/453 |
| 4,057,190 | 11/1977 | Kiwior et al. | 239/533.12 X |
| 4,106,702 | 8/1978 | Gardner | 239/533.3 |
| 4,139,158 | 2/1979 | Uchida | 239/533.12 |
| 4,200,237 | 4/1980 | Urlaub | 239/533.12 |
| 4,666,088 | 5/1987 | Krauss et al. | 239/533.12 |
| 4,693,424 | 9/1987 | Sczoniak | 239/533.11 X |

FOREIGN PATENT DOCUMENTS

| | | | |
|---|---|---|---|
| 74014 | 11/1944 | Czechoslovakia | 239/517 |
| 90021 | 8/1958 | Netherlands | 239/533.12 |
| 1183186 | 10/1985 | U.S.S.R. | 239/519 |
| 558928 | 1/1944 | United Kingdom | 239/533.9 |

*Primary Examiner*—Andres Kashnikow
*Assistant Examiner*—Mary Beth O. Jones

[57] ABSTRACT

The fuel injection nozzle has a nozzle body 11 with a movable fuel control valve 13. At the front end of the nozzle body 11 there is a spray tip 12 with the discharge orifices 16. The fuel jet disintegrator 17 is running through two opposite located discharge orifices 16. The ends 18 of the disintegrator 17 have a shape of a spring with outer diameter greater than a diameter of the discharge orifices 16. During the operation, fuel jet, coming from the discharge orifice 16, impinges on the disintegrator 17, breaks up into a multitude of tiny particles and produces spray which provides more complete burning of the fuel with the reduction in smoke and fuel consumption.

4 Claims, 2 Drawing Sheets

IMPINGING-JET FUEL INJECTION NOZZLE

BACKGROUND

1. Field of Invention

This invention relates to a fuel injection nozzle for a diesel engine. This nozzle generally comprises a nozzle body having a spray tip with the discharge orifices and an axially movable fuel control valve within the nozzle body.

2. Description of Prior Art

In the diesel engine the fuel is injected under high pressure into the combustion chamber with a high temperature air charge. To insure a good mixing of the fuel with the air, the injection is carried out by single or multi-holed nozzles. These nozzles were disclosed by the U.S. Pat. Nos. 4,106,702; 4,139,158 and 4,200,237. The essential diesel-engine's operational characteristics, such as fuel consumption, thermal and mechanical loads, smoke and exhaust emissions, are decisively influenced by the fuel-air mixing during the combustion process. Fuel-air mixing is affected by a range of design and operating variables which include fuel injection velocity, the geometry of the combustion chamber, the air charge motion and the nozzle configuration. One of the important characteristics of the fuel nozzle is spray formation or control of the physical characteristics of the spray so as to secure proper mixing of fuel and air both in time and space.

It is known that the fuel jet produced by a conventional hole type fuel injection nozzle consists of the very compact center portion of the spray, or the core, and the peripheral portion. This nozzle usually provides good atomization only in the peripheral portion of the fuel jet, giving a relatively fuel-rich mixture in the core. Consequently, during combustion, the peripheral portion of the spray is quickly evaporized in a high temperature gas; however, the evaporation of the core is slower and thus is the major cause of the smoke formation and inefficient engine operation.

Another problem in the current hole type nozzle is associated with the discharge orifices. Experience has shown that the size of the nozzle discharge orifices has a marked effect on the degree of atomization. The smaller the discharge orifice, the better atomization and faster fuel-air mixing. On the other hand, the smaller the orifice, the higher the probability that it will be plugged by carbon deposits or impurities in the fuel.

OBJECTS AND ADVANTAGES

It is the primary object of the present invention to provide a fuel injection nozzle of the type mentioned at the beginning, with a high degree of atomization and distribution of the fuel throughout the air charge in the combustion chamber, to achieve maximum efficiency and completeness of fuel combustion.

Another object of the present invention is to avoid the problems associated with the formation of the hard carbon deposits inside the nozzle discharge orifices.

To achieve these aims according to the invention, the conventional fuel injection nozzle is provided with a fuel jet disintegrator. This device facilitates the disintegrating process of the fuel jets coming from the discharge orifices and promotes greater mixing of the fuel with the air. This novel nozzle is capable of improving several aspects of the diesel engine emissions and performance simultaneously.

These and other objects and advantages of the present invention will become more apparent from the following description with the accompanying drawings.

DESCRIPTION OF THE DRAWINGS

The nature and objects of the invention are illustrated and described in reference to the following drawings, which also illustrate the preferred embodiments of the invention.

DRAWING REFERENCE NUMERALS

Figure 1:
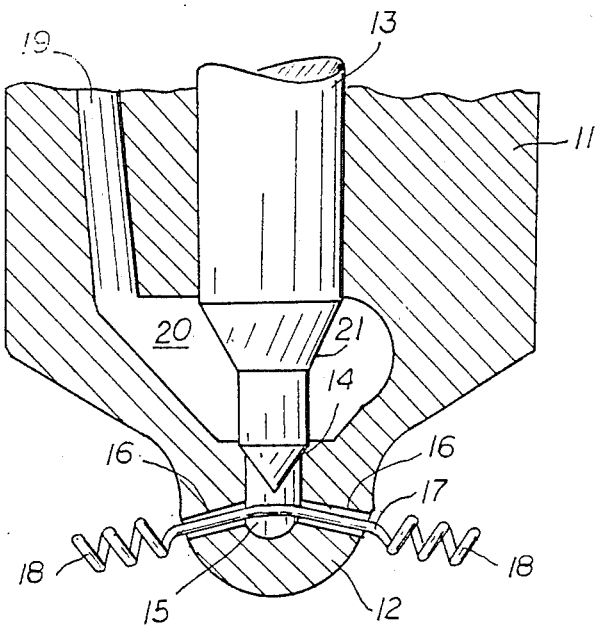
FIG. 1 shows a sectional view of an impinging-jet fuel injector with inserted spring.

11: nozzle body
12: spray tip
13: control valve
14: valve seat
15: discharge chamber
16: discharge orifice
17: disintegrator
18: disintegrators end
19: fuel duct
20: pressure chamber
21: differential surface
22: threaded widened part of the discharge orifice
23: disintegrator
24: springs end
25: disintegrator
26: disintegrator
27: threaded part of the nozzle body
28: retaining ring.

DESCRIPTION OF THE PREFERRED EMBODIMENT

In the embodiment of FIG. 1 an impinging-jet fuel injection nozzle consists of a nozzle body 11 with a spray tip 12 and an axially movable fuel control valve 13 within the nozzle body 11. The fuel control valve 13 is engageable with the valve seat 14 to control fuel flow into a chamber 15 from a fuel source (not shown). The tip 12 is provided with at least one discharge orifice 16. This orifice respectively opens from the chamber 15 into engine's combustion chamber (not shown). The main novelty of the present invention is a disintegrator 17 of the fuel jet going from the discharge orifice 16. The disintegrator 17 is made of a wire which runs within discharge orifice 16 and chamber 15. The shape and dimension of the disintegrator ends 18 depend on desired fuel spray pattern, and for example, can have a shape of a cylindrical or conical spring with outer diameter more than the diameter of the discharge orifice 16.

During the operation, fuel under high pressure generated by a fuel source, flows through the fuel duct 19 in the nozzle body 11 and enters into the pressure chamber 20. When the fuel pressure exerts sufficient force on the differential surface 21 to overcome the opposing spring preload, the control valve 13 is lifted off its seat 14, thus allowing fuel to enter the discharge orifice 16 and then into the combustion chamber. In accordance with the principle of the invention, when the fuel jet exits the discharge orifice 16 it impinges on the disintegrator 17, breaks up into a multitude of tiny particles and produces a conical, somewhat hollow spray, hence greatly increasing the total surface area of the fuel. Due to this new type of atomization, which may be called "impingement atomization" the fuel jet mixing with the air charge is greatly improved. This improved mixing provides more complete burning of the fuel with the reduction in smoke and fuel consumption. In addition, the motion of the disintegrator 17 inside the discharge orifice 16 tends to reduce the formation of the carbon crust on the wall of these orifices; i.e., provides the self-cleaning action.

Figure 2:
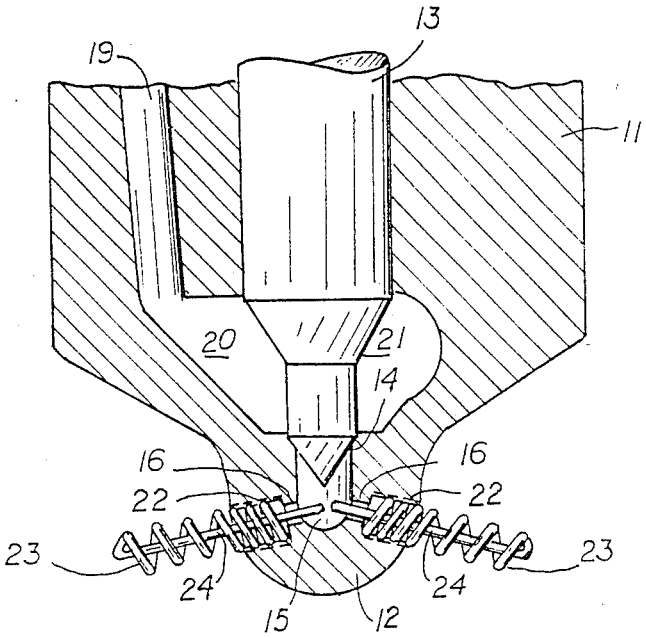
FIG. 2 shows a sectional view of another embodiment of the impinging-jet fuel injector with inserted spring.
Figure 3:
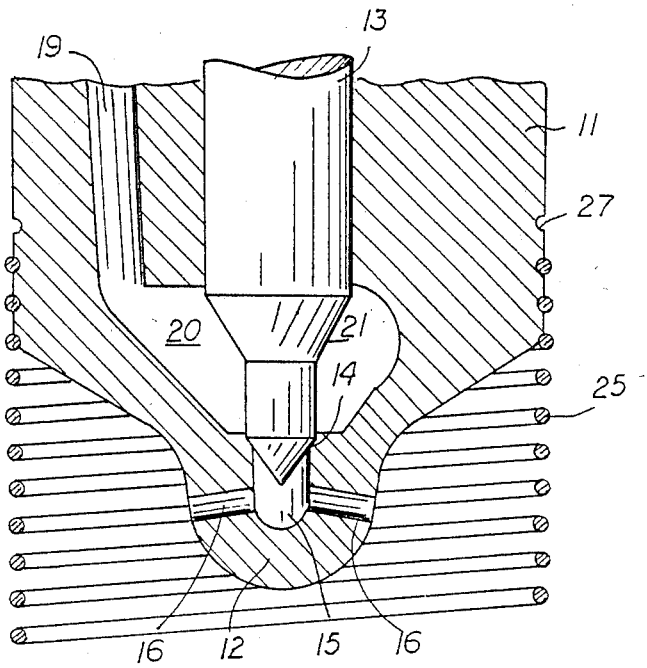
FIG. 3 shows a sectional view of an impinging-jet fuel injector with a screen.
Figure 4:
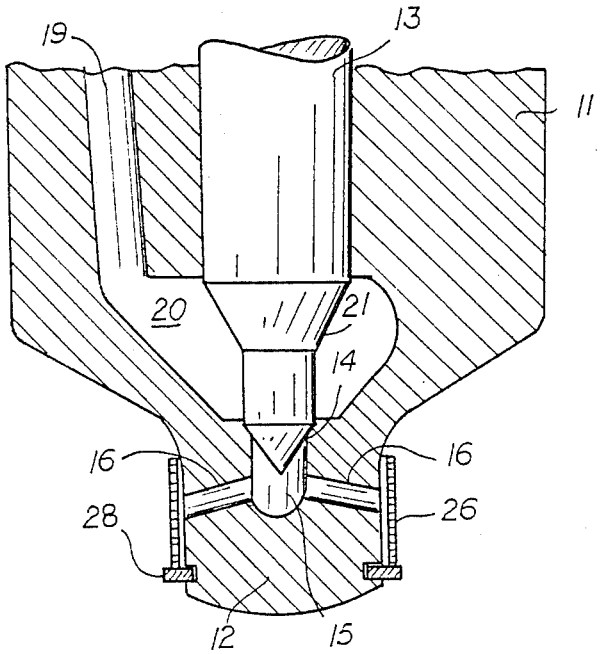
FIG. 4 shows a sectional view of the impinging-jet fuel injector with a screen according to another embodiment of this invention.

With the embodiments of FIGS. 2, 3 and 4 those elements which have the same function as in the embodiment of FIG. 1 are provided with the same references as in FIG. 1.

The impinging-jet fuel injection nozzle, according to FIG. 2, differs from that of FIG. 1 by the fact that the discharge orifice 16 has a threaded widened section 22 on outlet, and that the disintegrator 23 is made from a spring. This spring is screwed into the widened section 22. In order to achieve self-cleaning ability one of the ends 24 of the spring's wire is curved and going within spring 23 and discharge orifice 16 into the chamber 15.

As can be seen from FIG. 1 and FIG. 2 the disintegrators 17 and 23 runs as an extension of the longitudinal axis of the discharge orifice 16 into the combustion chamber.

Moreover, during the operation these disintegrators permit the injected fuel jets to pass through without alteration of their direction.

In the embodiment of FIG. 3 the nozzle body 11 has a threaded part 27 just above the spray tip 12. The disintegrator 25 has a shape of a cylindrical spring which is screwed onto an outer thread 27 of the nozzle body 11 and surrounds the spray tip 12.

FIG. 4 illustrates another embodiment of the present invention. In this case the spray tip 12 is surrounded by the disintegrator 26 which has the shape of a cylinder and made of a wire screen. The disintegrator 26 is retained on the spray tip 12 by a retaining ring 28, located in a groove.

The dimensions and configuration of the disintegrators 25 and 26 are determined empirically as the functions of the characteristics of the nozzle and combustion chamber.

In the foregoing construction and arrangement of the present invention the fuel jet disintegrator plays a role of the device which facilitates the mixing of air and diesel fuel prior to combustion in a diesel engine combustion chamber.

In summary, it will be seen that the use of impinging-jet fuel injection nozzle allows:

Optimization of the spray pattern by changing dimensions and shape of the fuel jet disintegrator.

The achievement of better atomization of the fuel with relatively low injection pressure.

Reduction of the sensitivity of the fuel injection system to the variation of the engine operation conditions.

Construction of the nozzle with the bigger diameter of the discharge orifice.

Avoidance of carbonization of the discharge-orifices.

This invention could lead to the development of an entirely new type combustion process and resolve the conflicting requirements of noise, smoke emissions and economy of the diesel engine.

Modifications within the scope of the invention will be possible for those skilled in the art after receiving the teachings of the present disclosure.

I claim:

1. A fuel injection nozzle, comprising: a hollow nozzle body having a spray tip with at least one discharge orifice; an axially movable fuel control valve mounted within said nozzle body; a fuel jet disintegrator being attached to said nozzle body and running as an extension of the longitudinal axis of said at least one discharge orifice; said disintegrator comprising a wire which runs through said at least one discharge orifice, whereby the end of said wire extends outside said spray tip and has a shape of a spring with an outer diameter greater than a diameter of said at least one discharge orifice; and when injected fuel exits said at least one discharge orifice, it impinges on the spring-shaped end of the wire, thereby breaking into tiny particles.

2. A fuel injector according to claim 1, wherein said at least one discharge orifice comprises two oppositely located discharge orifices.

3. A fuel injection nozzle comprising:

a hollow nozzle body having a spray tip with at least one discharge orifice; an axially movable fuel control valve mounted within said nozzle body; a fuel jet disintegrator being attached to said nozzle body and running as an extension of the longitudinal axis of said discharge orifice; wherein said at least one discharge orifice has a threaded widened section on its outlet and said disintegrator has a shape of a spring which is screwed into said threaded widened section and leading from said at least one discharge orifice into the combustion chamber; and when injected fuel exits said at least one orifice, it impinges on the portion of the spring leading from said at least one discharge orifice, thereby breaking into tiny particles.

4. A fuel injection nozzle according to claim 3, wherein an end portion of said disintegrator located outside of said spray tip is curved and extends within said spring and said discharge orifice.

* * * * *